US006565371B1

(12) United States Patent
Watanabe

(10) Patent No.: US 6,565,371 B1
(45) Date of Patent: May 20, 2003

(54) CONNECTOR AND ROBOT SYSTEM

(75) Inventor: Hiroshi Watanabe, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/743,310

(22) PCT Filed: May 10, 2000

(86) PCT No.: PCT/JP00/02984

§ 371 (c)(1),
(2), (4) Date: Mar. 12, 2001

(87) PCT Pub. No.: WO00/69030

PCT Pub. Date: Nov. 6, 2000

(30) Foreign Application Priority Data

May 10, 1999 (JP) ..... 11-165755

(51) Int. Cl.[7] ..... H01R 13/44
(52) U.S. Cl. ..... 439/138; 439/924.1
(58) Field of Search ..... 439/131, 136, 439/137, 135, 138, 142, 924.1

(56) References Cited

U.S. PATENT DOCUMENTS 4,773,032 A * 9/1988 Uehara et al. ..... 364/709
5,295,844 A * 3/1994 Koshikawa et al. ..... 439/138
5,904,597 A * 5/1999 Doi et al. ..... 439/660

FOREIGN PATENT DOCUMENTS

| | | |
|---|---|---|
| JP | 51-103307 | 8/1976 |
| JP | 61-90175 | 6/1986 |
| JP | 63-198270 | 8/1988 |
| JP | 1-92088 | 6/1989 |
| JP | 145069 | * 10/1989 |
| JP | 3-35672 | 4/1991 |
| JP | 3-285503 | 12/1991 |
| JP | 4-124776 | 11/1992 |
| JP | 4-135176 | 12/1992 |

* cited by examiner

*Primary Examiner*—Tulsidas Patel
(74) *Attorney, Agent, or Firm*—Frommer Lawrence & Haug LLP; William S. Frommer; Matthew K. Ryan

(57) ABSTRACT

A connecting device and a robot having a cover on a first connector half unit, usually covering first electrodes and turning so that first electrodes come out of electrode projection holes when a second connector half unit is pushed against said first connector half unit, resulting in a state wherein said first electrodes are covered up when said first and second connector units are not connected. Consequently electrical reliability and safety can be remarkably improved.

4 Claims, 11 Drawing Sheets

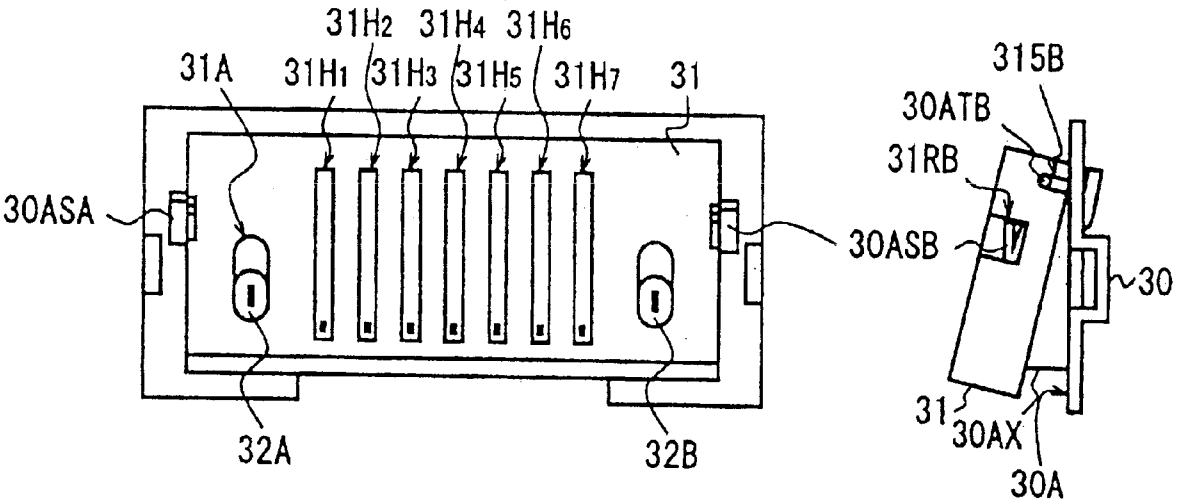
FIG. 7A
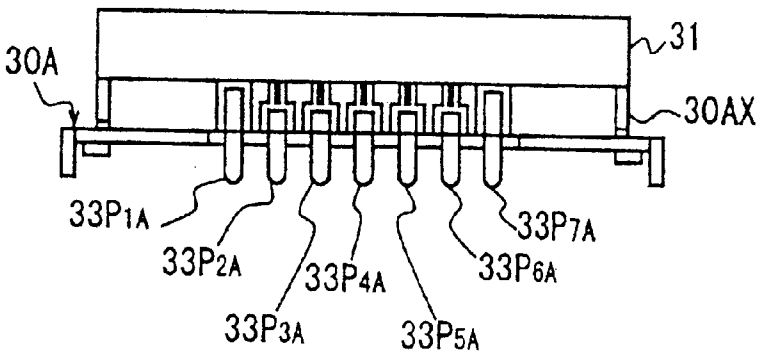
FIG. 7B
FIG. 7C
12C

13C

CONNECTOR AND ROBOT SYSTEM

TECHNICAL FIELD

This invention relates to a connecting device and a robot, and is suitably applied to a connector for electrically connecting a robot having a built-in secondary battery and an exclusive charger.

BACKGROUND ART

There has been a connector 1 of this type as shown in FIG. 11, comprising a connector half unit 3 having a plurality of projecting electrode terminals 2 and another connector half unit 5 having electrodes (pad) 4 corresponding respectively to each electrode terminal 2.

When using the connector 1 in a robot comprising a four-leg walking pet robot performing specific actions in accordance with directions from the user, the surrounding environment and an exclusive battery charger, the first connector 3 and the second connector 5 are placed in order to engage with the pet robot and the battery charger respectively.

In this pet robot, connecting the pet robot to the battery charger causes the first and second connectors 3,5 to thrust into each other, whereby each terminal 2 of the first connector half unit 3 comes into contact with corresponding terminal 4 of the second connector (half unit) 5, succeeding in the electrical connection of the pet robot and the batter charger.

Thus constructed, the connector 1 is, however, prone to have a problem of low reliability in electrical connectivity of the first and second connectors 3, 5, because the terminal 2 of the first connector 3 is always projected and exposed outside, it is easy to get dirty and broken.

Moreover, accordingly, in the case where the terminal of the first connector 3 is always projected and exposed outside, there has been a problem of low safety; the user has had a danger of getting electrical shocks and injuries, touching the terminal 2 of the first connector 3.

DISCLOSURE OF THE INVENTION

The present invention has been done considering those problems and is intended to offer a connecting device and a robot capable of improving electrical connectivity and safety. To obviate such problems according to this invention a cover is provided for connecting means comprising a first connector having a first terminal and a second connector having a second terminal corresponding to said first terminal. The first connector is provided with terminal projection slits corresponding to said first electrode terminals and a cover which usually covers the first terminals. When the second connector is pushed against the first connector, however, this cover turns so that the first electrode terminals may come out of the slits. As a result, with this connecting device, when the first and second connectors are not in contact with each other, the first electrode terminals are covered by the cover, whereby the first electrode terminals are prevented from getting dirty or broken, resulting from the user touching them, and the user is fully protected from electrical shocks and harm beforehand. Consequently the electrical reliability and safety can be substantially increased.

Also, according to this invention, in a robot comprising charging means incorporating the first electrode having the first terminals and the second connector having the second terminals corresponding to the first terminals, the first connector is provided with a set of terminal projection slits corresponding to the first terminals and a cover, which usually covers the first terminals and turns so that the first terminals may thrust out of the terminal projection slits when the second connector is pushed against the first connector.

As a result, with this robot, since the first electrode is covered by the cover when the robot is not connected to the charger, the first electrode terminals are prevented from getting dirty or broken, possibly resulting from the user touching them, and the user is surely protected from electrical shocks and harm beforehand. Consequently the electrical reliability and safety are substantially increased.

BRIEF DESCRIPTION OF THE DRAWINGS

FIG. 7A is a top plan view showing the structure of the first connector half unit.

FIG. 7B is a front plane view of the first connector half unit of FIG. 7A.

FIG. 7C is a side plan view of the first connector half unit of FIG. 7A.

BEST MODE FOR CARRYING OUT THE INVENTION

Figure 1:
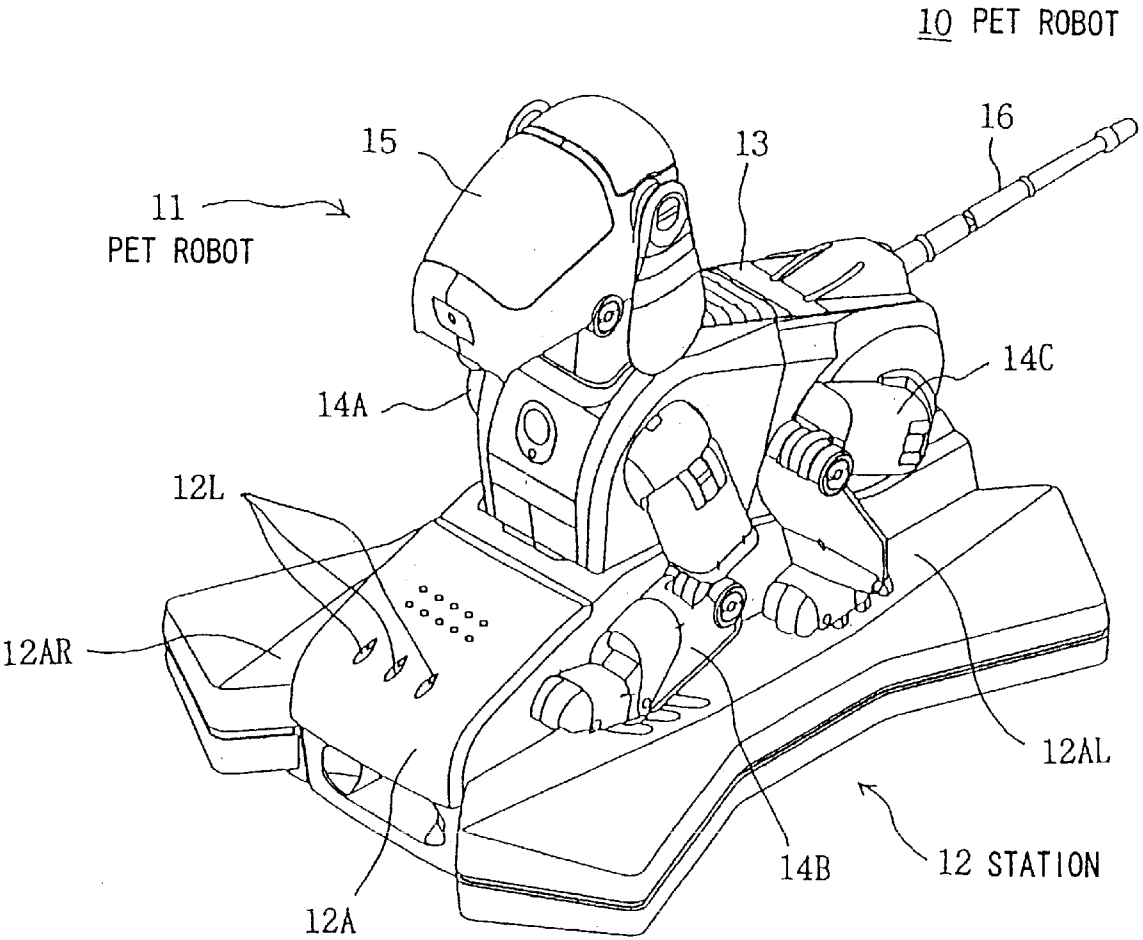
FIG. 1 is a perspective view showing the structure of a pet robot, according to the present invention.

A mode of carrying out the present invention is described in detail hereunder, referring to the drawings.

(1) Configuration of a Pet Robot Embodying this Invention.

Figure 2:
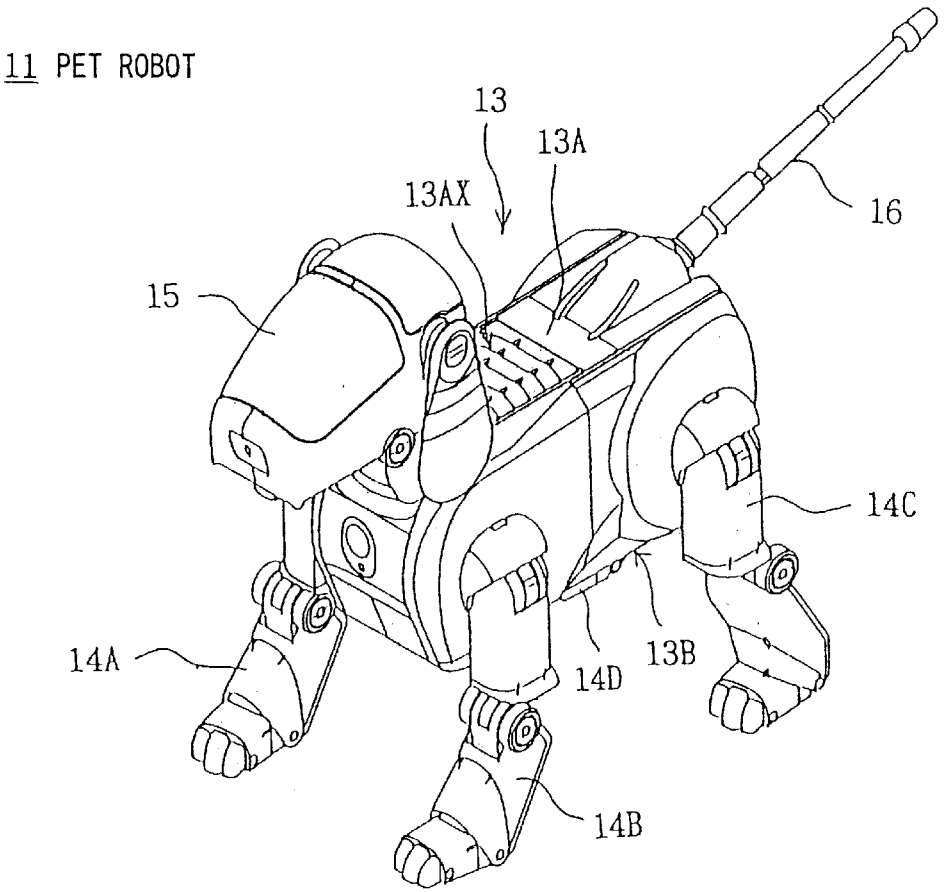
FIG. 2 is a perspective view showing the structure of the pet robot shown in FIG. 1.
Figure 3:
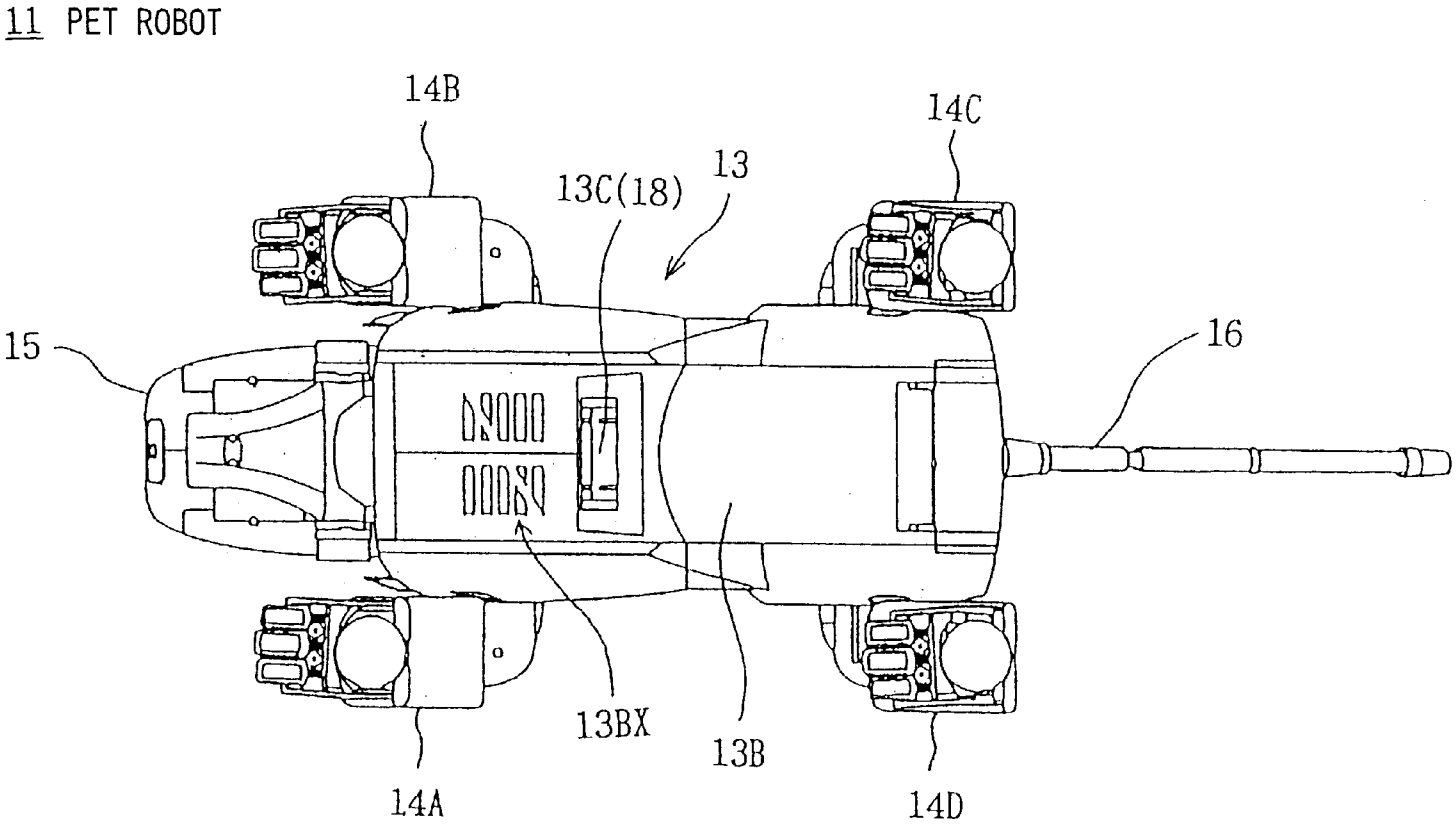
FIG. 3 is a perspective view showing the structure of the pet robot shown in FIG. 1.

The reference numeral 10 represents the overall view of the pet robot according to an embodiment of the present invention as is illustrated in FIGS. 1–3. A battery (not shown in Figure) built in the pet robot 11 is charged when the pet robot 11 is placed on the designated part of an exclusive battery charger (hereinafter referred to as the 'Station'), with a given posture. As shown in FIG. 2 and FIG. 3, in practice the pet robot 11 consists of four leg units 14A–14D linked at the left, right, front and rear of the body unit 13 and the head and tail units 15, 16 connected to the front edge part and rear edge part of the body unit 13 respectively. A cooling fan (not shown in Figure) is provided inside of the body unit 13, through which an air exhaust port 13AX and an air intake port 133BX are formed on the upper plane 13A and the bottom 13B. This, in the pet robot 11, the air taken in from the intake port 13BX is exhausted from the exhaust port 13AX through the inside of the body unit 13 according to the motion of the cooling fan, whereby the temperature in the body unit 13 is prevented from rising.

The second connector half unit 13C having a set of bare electrodes (pad) is placed at the bottom 13B of the body unit 13, forming a half of the connector 18 according to this embodiment of the present invention.

Figure 4:
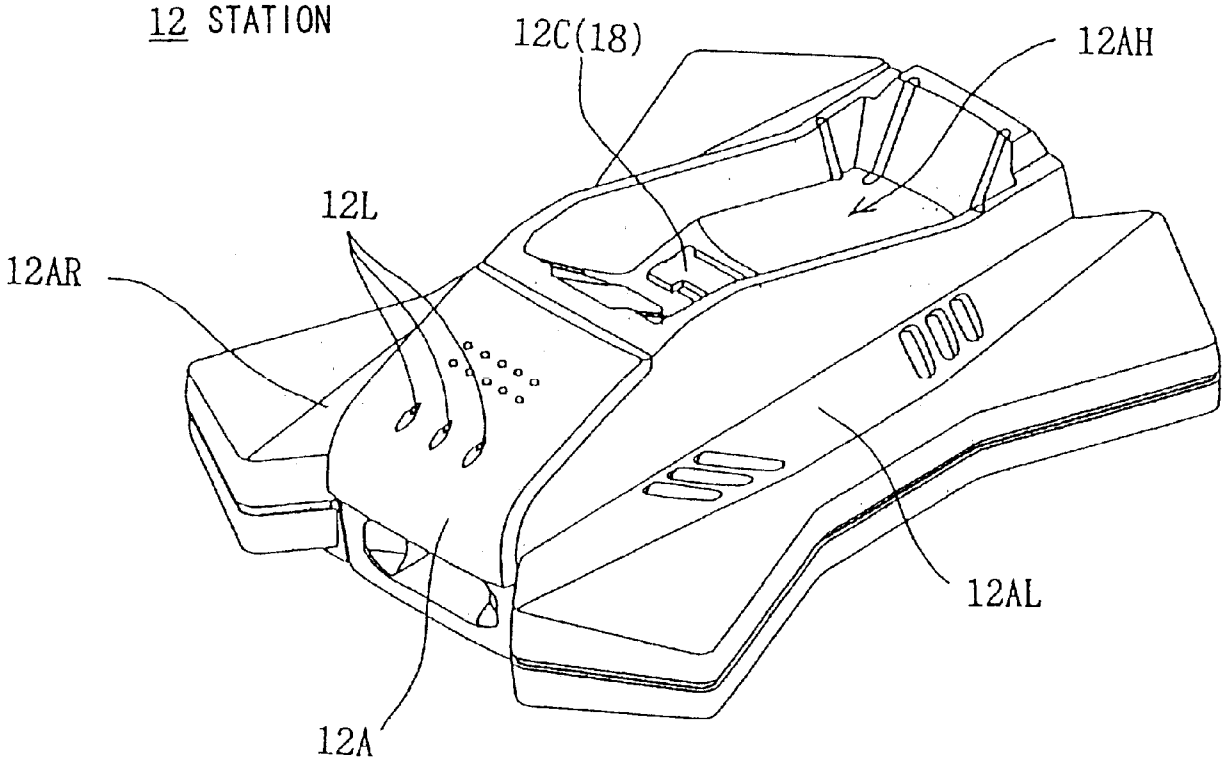
FIG. 4 is a perspective view showing the structure of the station in FIG. 1.

The station 12 is connected to the household power source receptacle via the AC adapter by means of the wiring drawn from the built-in charger. As to the external appearance, as shown in FIG. 4, the concave space 12AH to receive the body unit 13 of the pet robot 11, is formed at the center of the upper plane of the main part 12A, and simultaneously the flat planes 12AR, 12AL are formed longitudinally along both sides of the concave space 12AH.

The first connector half unit having the projected electrode terminals (not shown in Figure) corresponding to each electrode of the second connector half unit 13C on the pet robot 11 side is provided in the concave space 12AH on the station 12, forming the other half of the connector 18.

Furthermore, a plurality of LED lamps 12L are arranged on the front face of the main part 12A of the station 12 so that the user can know whether or not the plug of the AC adapter (not shown in Figure) connected to the station 12 is connected to the power source, whether or not the battery (not shown in Figure) built in the inside of the pet robot 11 is charged, or whether or not a spare battery housed detachably in the station 12 is charged, by way of each LED indicator, lighting up or blinking in a specific color.

In putting the pet robot 11 and the station 12 together, the pet robot 11 is changed to the posture of 'lie-down' with the lower part 13B (abdomen) of the body unit 13 approaching the floor with leg units 14A~14D crooked. (This posture is, hereinafter, referred to as 'station transition posture'.)

The user will hold up the pet robot 11 in this posture and put it on the station 12 so that the body unit 13 may fit into the space 12AH on the station 12, resulting in the engagement of the second connector half unit 13C of the body unit 13 and the first connector half unit 12C on the station 12, whereby the electrical connection is attained.

At this point, since the pet robot is in the 'station transition posture', the leg units 14A~14D become no hindrance when putting the body unit 13 into the space 12AH, and the feet of the leg units 14A~14D are attached and held firm onto both flat planes 12AR, 12AL on the main part 12A of the station 12.

(2) Internal Structure of Pet Robot 11

Figure 5:
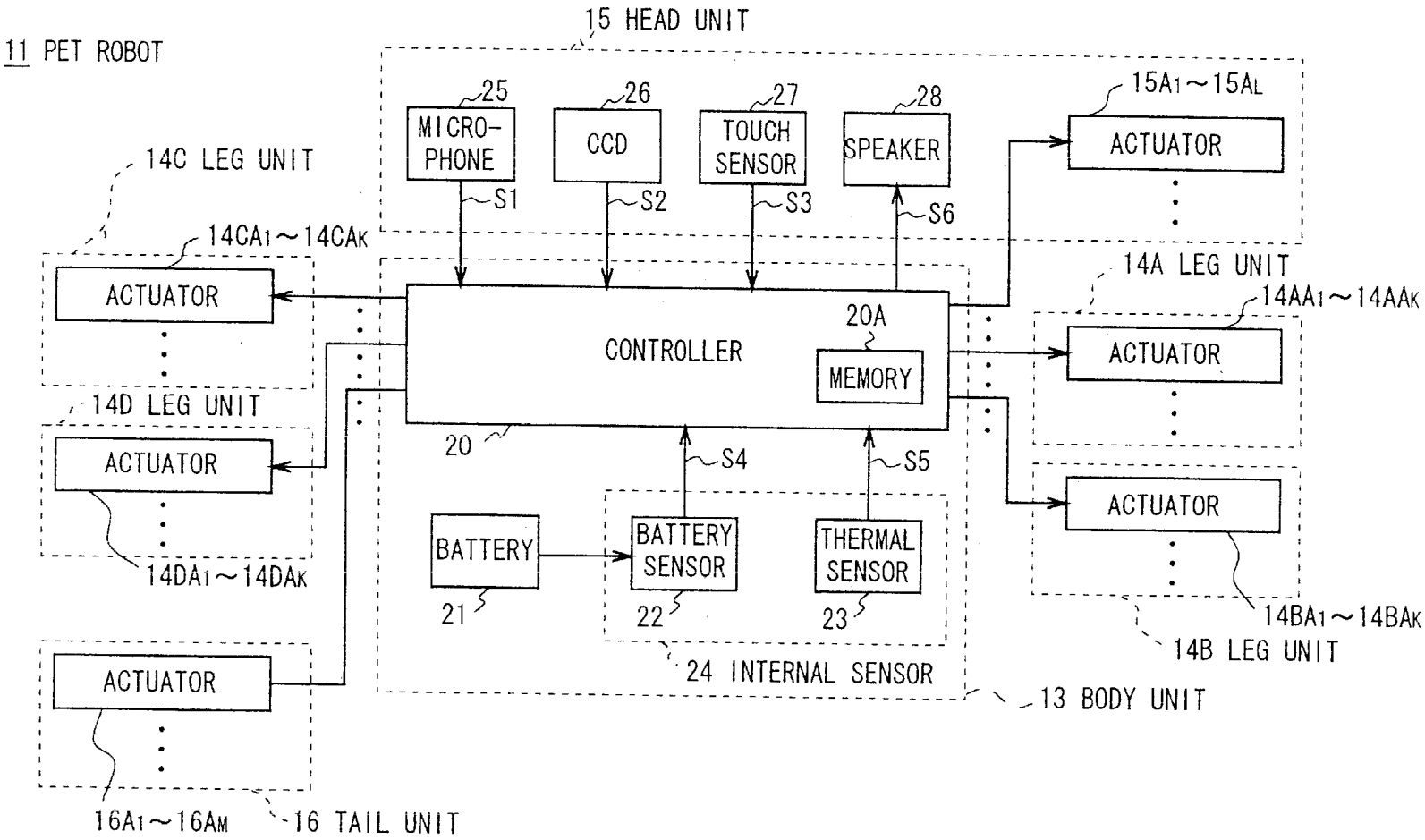
FIG. 5 is a block diagram showing the structure of the pet robot in FIG. 1.

As shown in FIG. 5, in the pet robot 11, a controller 20 for controlling the whole operation of the pet robot, a battery 21 or a power source for the pet robot 11, and an internal sensor 24 comprising a battery sensor 22 and a thermal sensor 23 are stored in t he body unit 13.

The head unit 15 is equipped with a microphone 25 working as the 'ear', a CCD (Charge Coupled Device) camera 26 working as the 'eye', a touch sensor, and a speaker 28 working as the 'mouth', at the designated position respectively.

Actuators $14AA_1$~$14AA_K$, $14BA_1$~$14BA_K$, $14CA_1$~$14CA_K$, $14DA_1$~$14DA_K$, $15A_1$~$15A_L$, and $16A_1$~$16A_M$ are placed at the joints of the leg units 14A~14D, and the connection points of the leg units 14A~14D and the body unit 13, the head unit 15 and the body unit 13, the tail unit 16 and the body unit 13 respectively.

The microphone 25 of the head unit 15 collects the command sounds such as "Walk", "Lie Down" or "Follow the Ball", given out in the form of the scales by means of the sound commands (not shown in Figure, commands generating sounds on different scales in accordance with the operation contents), and an audio signal S1 obtained whereby is sent out to a controller 20. The CCD camera 26 photographs the surroundings and a picture image S2 produced is sent to the controller 20.

Furthermore, a touch sensor 27, located at the upper part of the head unit 15, as clearly shown in FIG. 2, detects a pressure generated upon receiving physical actions from the user (such as "Stroke" or "Pat") and outputs and sends the result to the controller 20 as a pressure detection signal 3.

Moreover, a battery sensor 22 of the body unit 13 detects a residual electric charge of the battery 21 in five levels, and transmits the detection result of each level obtained to the controller 20 as a battery residual detection signal S4 sequentially.

In this case, the battery sensor 22 detects the residual electric charge classifying in stages, i.e., if the residual is more than 80% (Full), 80~50% (Middle-full), 50~25% (Middle), 25~20% (Low) and less than 20% (Low-Low).

The thermal sensor 23 of the body unit 13 detects the internal temperature of the pet robot 11, and the resultant is fed to the controller 20 as a thermal detection signal S5.

The controller 20 judges the surroundings, existence of commands or operations from the user, based on the audio signal S1, image signal S2, pressure detection signal S3, battery residual detection signal S4, and thermal detection signal S5 given through the microphone 25, CCD camera 26, touch sensor 27, battery sensor 22 and thermal sensor 23 respectively.

Then, the controller 20 determines subsequent actions based on the judgments and control programs entered beforehand, and driving the actuators $14AA_1$~$14AA_K$, $14BA_1$~$14BA_K$, $14CA_1$~$14CA_K$, $14DA_1$~$14DA_K$, $15A_1$~$15A_L$, and $16A_1$~$16A_M$, makes the head unit 15 shake up and down, left to right, the tail unit 16 wag, and the leg units 14A~14D move like walking.

In this instance the controller 20, feeding a predetermined audio signal S6 to the speaker 28 as required, puts out a voice based on the audio signal S6, and turns on or off, or blinks the LED (Light Emitting Diode, not shown in Figure) positioned on the same level of the eyes of the pet robot 11.

Thus, the pet robot 11 can act autonomously in response to the surroundings and control programs.

(3) Structure of the Connector According to the Embodiment of this Invention

In practice, in the first connector half unit 12C, of the station 12 side, as delineated in FIGS. 6 and 7A~7C, a protection cover 31 made of an insulating material is attached to the base 30 flexibly so that it can turn within a predetermined range, in a longitudinal direction (in the direction of the arrow X) as the center of rotation.

Figure 6:
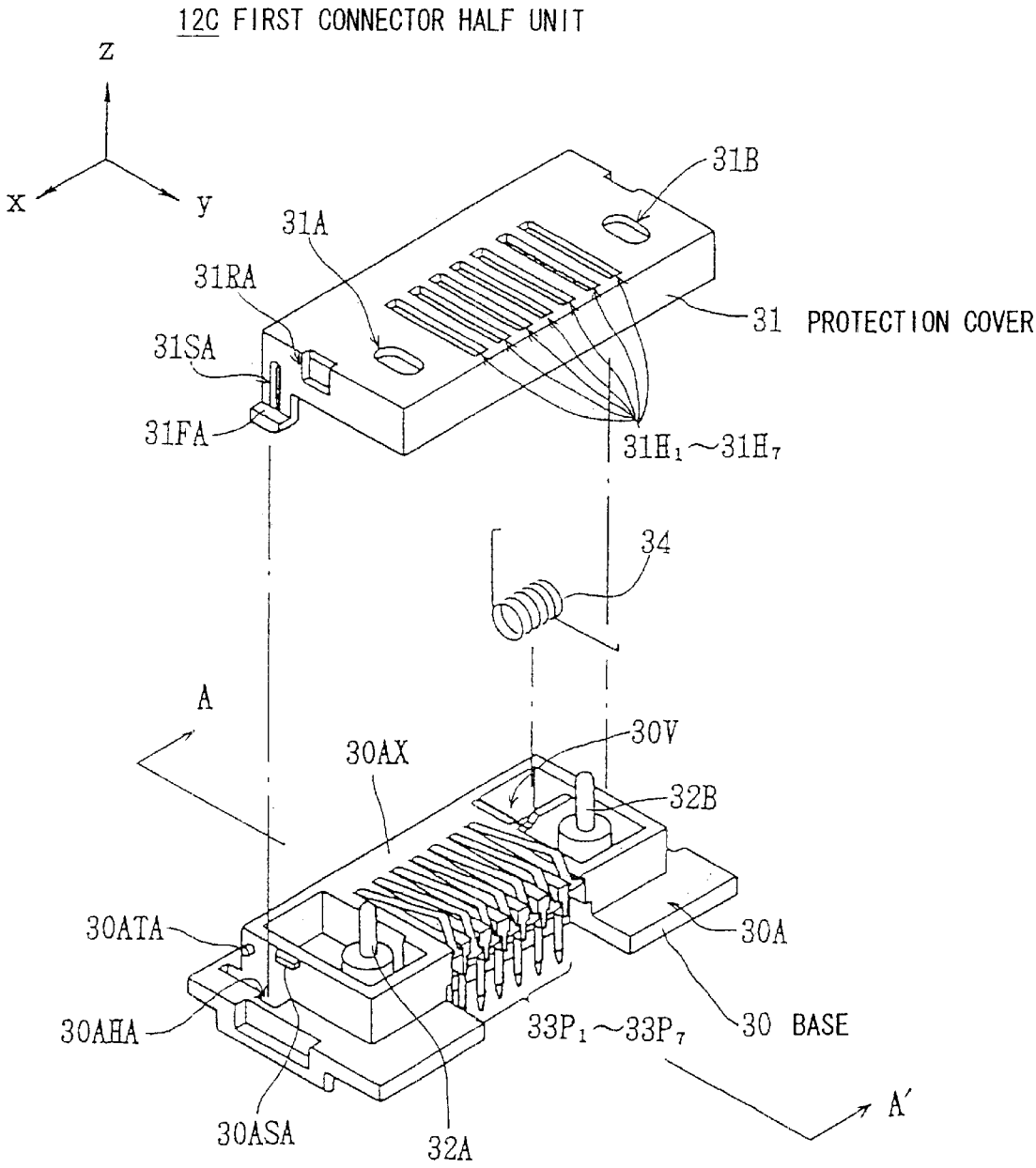
FIG. 6 is an exploded perspective view showing the structure of the first connector half unit.

Relating to the base 30, the stage 30AX is provided on the plane A facing the second connector half unit 13C (FIG. 3), and a pair of guide pins 32A and 32B are arranged on both ends of the stage 30AX. And, a plurality of electrode terminals $33P_1$~$33P_7$ made of a conducting and an elastic material are arranged between the guide pins 32A and 32B in a row, with a predetermined pitch, along the longitudinal direction of the base 30. Each electrode terminal $33P_1$~$33P_7$ is, as delineated in FIG. 8A, a cross sectional view on the A–A' line of FIG. 6, is placed inside of the base 30 with the center U-shaped part $33P_{1M}$~$33P_{7M}$ fastened to it.

Also, one end $33P_{1A}$~$33P_{7A}$ and the other end $33P_{1B}$~$33P_{7B}$, of each of the electrode terminals 33, are crooked in an L-shape in the same direction. The tip of one end $33P_{1A}$~$33P_{7A}$ of the electrode terminals 33, jutting beneath the base 30 (in the opposite direction to the arrow Z) functions as contact pin.

The shape of each electrode terminal $33P_1$~$33P_7$ is selected so that the part $33P_{1BX}$~$33P_{7BX}$ crooked in an L-shape of the other end $33P_{1B}$~$33P_{7B}$ of each of the electrode terminal $33P_1$~$33P_7$, is weighed down by the elastic load of its own of each of the electrode terminals $33P_1$~$33P_7$.

(In FIGS. 9A and 9B) Of a plurality of the electrode terminals $33P_1$~$33P_7$, the two electrode terminals $33P_1$, and $33P_7$ positioned at the far ends, are designated as the terminals for power supply and grounding terminals respectively and are so designed that their crooked part $33P_{1BX}$ and $33P_{7BX}$ may jut out a bit higher (in the direction of the arrow Z) than that of the rest of other terminals $33P_2$~$33P_6$ (FIG. 7A).

Moreover, a spring housing space 30V is formed on the part of the base 30 whereon the guide pin 32B stand, and a coil spring 34 is housed with one end fixed to the spring housing space 30V.

Furthermore, rotation guide grooves 30AHA and 30ATA in a given shape are provided on both ends of the base of the stage 30AX of the base 30, and a pair of bosses 30ATA, 30ATB and a pair of stoppers 30ASA, 30ASB are formed at both edges of the stage 30AX, maintaining a predetermined positioning.

As to the protection cover 31, a plurality of holes or slits $31H_1$ to $31H_7$, (through which the electrodes may protrude), are arranged corresponding to the crooked part $33P_{1BX}$~$33P_{7BX}$ of the electrode terminals $33_1$~$33P_7$ on the base 30, and elliptical guide holes 31A and 31 are formed corresponding to a pair of the guide pins 32A and 32B in the direction of the arrow Y.

Also, the protection cover 31 has a pair of lobes 31FA and 31FB at the lower ends of both sides, along which there are formed slide holes 31SA and 31SB extending upwards (in the direction of the arrow Z), and rotation regulating holes 31RA and 31RB are arranged in the vicinity of said slide holes 31SA and 31SB, maintaining a predetermined positioning.

The protection cover 31 can be fitted into the base 30 upon freely sliding a pair of the columnar bosses 30ATA and 30ATB and a pair of the stoppers 30ASA and 30ASB of the base 30 into a pair of the slide holes 31SA and 31SB, and a pair of rotation regulation holes 31RA and 31RB, inserting the lobes 31FA and 31FB of the protection cover 31 into the rotation guide grooves 30AHA and 30AHB of the base 30 respectively, in a state in which the coil spring 34 is housed in the spring storage space 30V of the base 30.

Figure 8A:
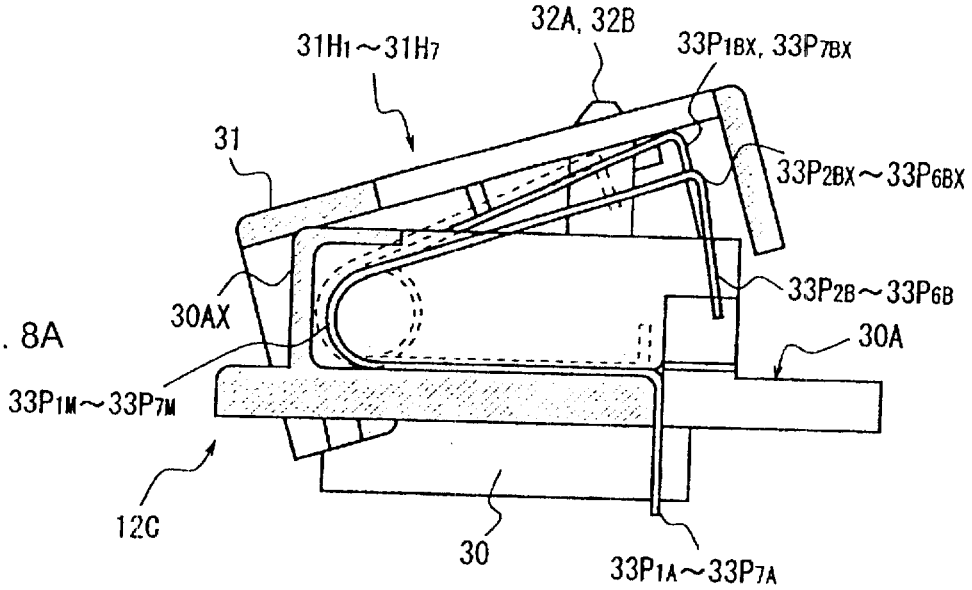
FIG. 8A is a partial cross sectional view illustrating a first linkage state of the first connector half unit with respect, to the cover.

In this case, as illustrated in FIGS. 8A and 7C, usually the protection cover 31 moves, by being urged by the resilience of the coil spring 34 interposed between the protection cover 31 and the base 30, in the direction of turning with a pair of the columnar bosses 30ATA and 30ATB placed on the base 30 as the axis of rotation, whereby it is fixed to the base 30 with a given angle of inclination, with its position regulated at a given angle by a pair of stoppers 30ASA and 30ASB.

In this case, although the guide pins 32A and 32B of the base 30 protrude a bit out of the guide holes 31A and 31B of the protection cover 31, the crooked part $33P_{1BX}$~$33P_{7BX}$ of the electrode terminals $33P_1$~$33P_7$ of the base 30 is hidden by the protection cover 31, without protruding out of the electrode projection hole $31H_1$~$31H_7$.

Figure 8B:
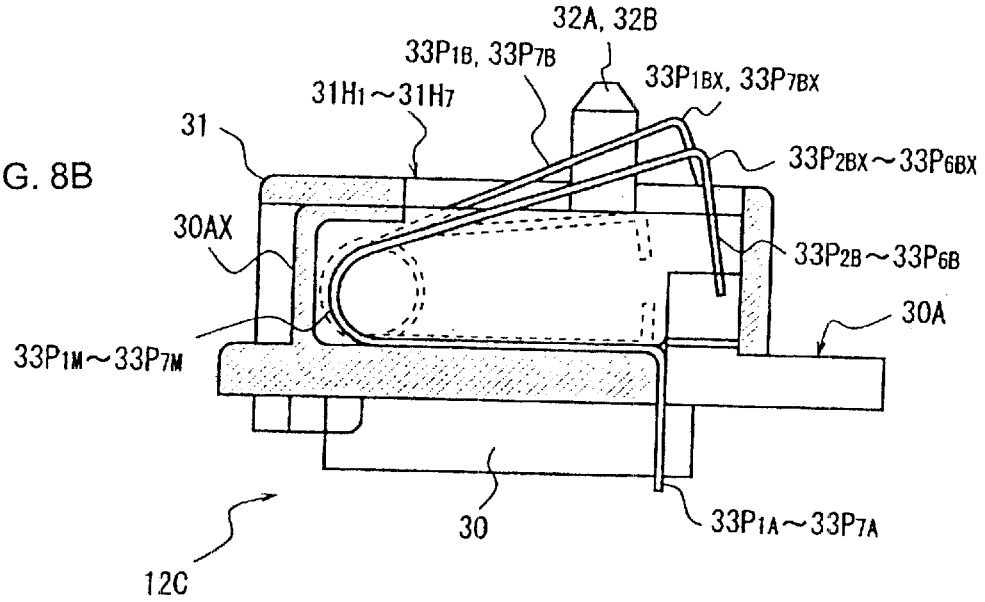
FIG. 8B is a partial cross sectional view illustrating a second linkage state of the first connector half unit with respect to the cover.
Figures 9A, 9B, 9C:
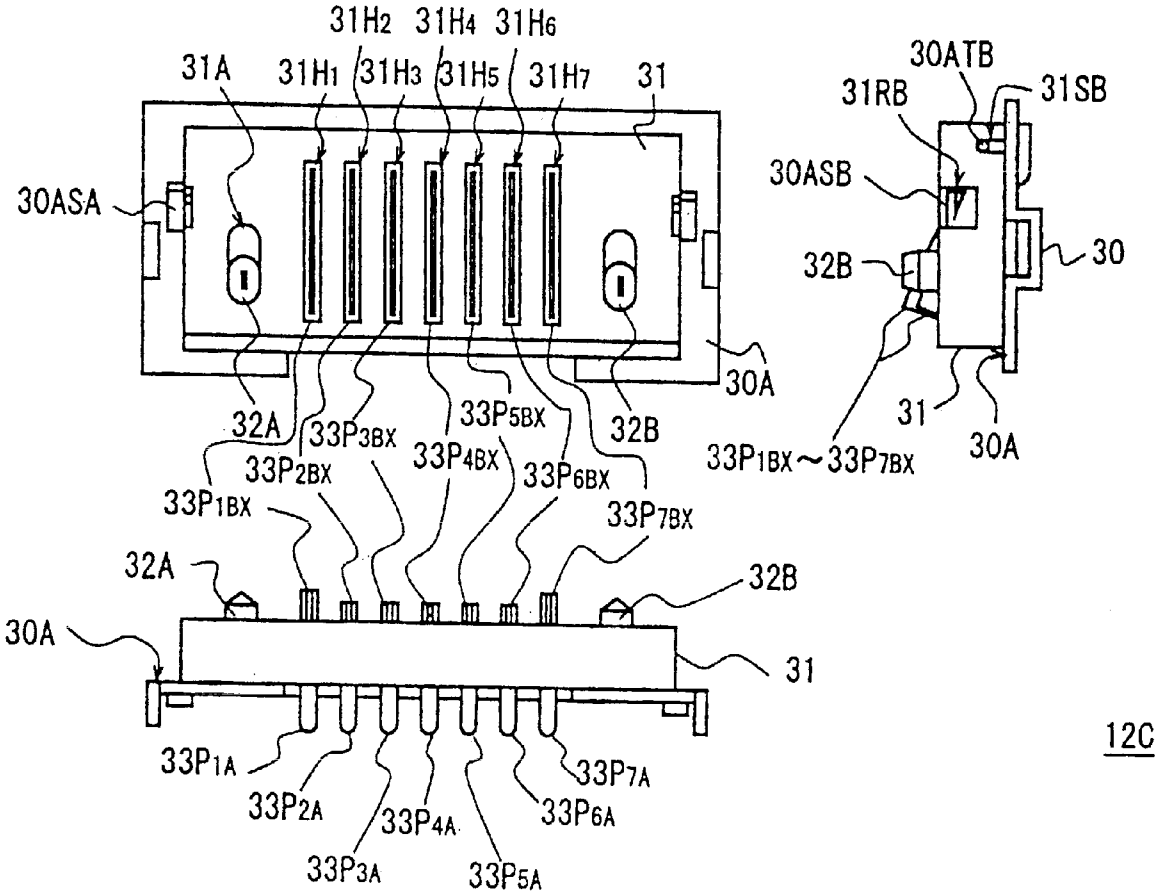
FIG. 9A is a top plan view of the structure of the first connector half unit.
FIG. 9B is a front plan view of the first connector half unit of FIG. 9A.
FIG. 9C is a side plan view of the first connector half unit of FIG. 9A.
Figure 10C:
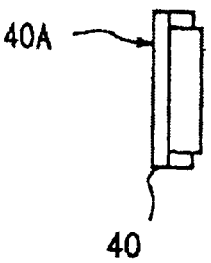
FIG. 10C is a side plan view of the first connector half unit of FIG. 10A.
Figure 10A:
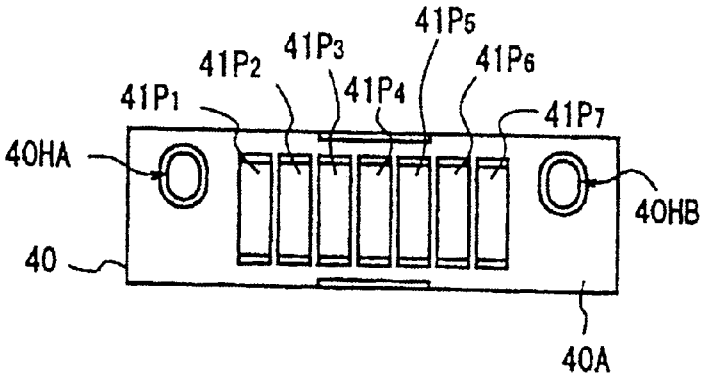
FIG. 10A is a top plan view of the structure of the first connector half unit.
Figure 10B:
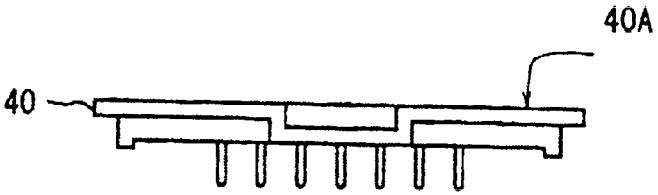
FIG. 10B is a front plan view of the first connector half unit of FIG. 10A.
Figure 11:
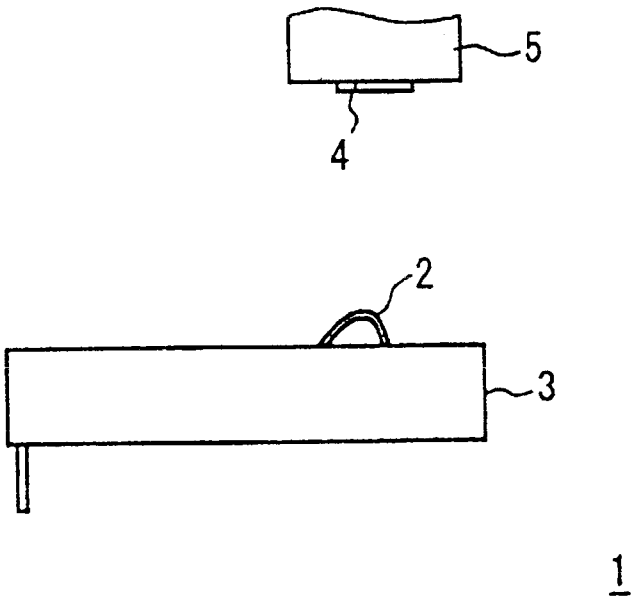
FIG. 11 (PRIOR ART)
FIG. 11 is a brief linear diagram showing the structure of a conventional connector.

To the contrary, when the protection cover 31 is pushed against the base 3 with a.pressure larger than the elastic energy of the coil spring, as FIGS. 8B and 9C show, it turns with a pair of columnar bosses 30ATA and 30ATB on the base 30 as the axis of rotation, and is subsequently fixed to the base 30 with an angle of inclination becoming '0'.

In this case, the guide pins 32A and 32B of the base 30 protrude out of the guide holes 31A and 31B of the protection cover 31 relatively to a long extent, and the crooked part $33P_{1BX}$~$33P_{7BX}$ Of all the electrode terminals $33P_1$~$33P_7$ of the base 30 sticks out through the electrode projection slit $31H_1$~$31H_7$.

The second connector half unit 13C comprises a plurality of flat electrodes (pad) $41P_1$~$41P_7$ made of a conducting material, each corresponding to an electrode projection slit $31H_1$~$31H_7$, respectively placed in a row on the plane 40 facing the first connector half unit 12C made of an insulating material on the base 40 and reference holes 40HA and 40HB corresponding to a pair of the guide pins 32A and 32B of the first connector half unit 12C.

Accordingly, with regard to the whole connector 18, the connectors 12C and 13C should be positioned properly, by applying a pressure to the protection cover 31 of the connector 12C so that it may approach the base 30, and regulated by a pressure along the guide pins 32A and 32B, the crooked part $33P_{1BX}$~$33P_{7BX}$ of the electrode terminals $33P_1$~$33P_7$ of the connector 12C can be contacted with the corresponding electrode $41H_1$~$41H_7$ of the connector 13C, thus accomplishing the electrical connection of the first and second connector half units 12C and 13C.

(4) Operations and Effects of the Embodiment in this Mode

With the structure of the robot system 10 as described hitherto, when charging the battery, the pet robot 11 is in a state of transitional posture and is placed on the station 12 with an appropriate positioning. At this moment the protection cover 31 of the connector 12C of the station 12 is pushed against the base 30 by the weight of the pet robot itself, subsequently making the electrode terminals $33P_1$~$33P_7$ of the first connector half unit 12C gradually stick out of the protection cover 31 through the corresponding electrode projection holes $31H_1$~$31H_7$, and finally the electrode connectors $33P_1$~$33P_7$ can be contacted with the corresponding electrodes $41P_1$~$41P_7$ of the second connector half unit 13C.

Whereas, when holding up the pet robot 11 off of the station after the completion of charging, one end of the protection cover 31 of the first connector half unit 12C starts opening with the other end as the center of rotation, by the resilience of the coil spring 34 interposed between the protection cover 31 and the base 30, consequently slowly pushing up the electrode projection holes $31H_1$~$31H_7$ towards the projected part of the electrode terminals $33P_1$~$33P_7$ of the first half of connector 12C. As a result, the crooked part $33P_{1BX}$~$33P_{7BX}$ of the electrode terminal $33P_1$~$33P_7$ is finally covered up.

Accordingly, with this pet robot, since the electrode terminals $33P_1$~$33P_7$ of the first connector half unit 12C are covered up by the protection cover 31 when the pet robot 11 is not connected to the station 12, the electrode terminals $33P_1$~$33P_7$ are prevented from getting dirty or broken easily, and the user is protected from getting electrically shocks or injuries beforehand, possibly caused by the user touching the electrode terminals $33P_1$~$33P_7$.

Furthermore, since a pair of the guide pins 32A and 32B placed on the first connector half unit 12C are regulated in regard to the positioning by the reference holes 40AH and 40HB, in connecting the pet robot 11 to the station 12, the user can connect the pet robot 11 to the station 12 easily even with an approximate positioning, requiring no intricate and precise positioning with the eye when the user tries to place the pet robot 11 onto the station 12.

Moreover, since the protection cover 31 of the first connector half unit 12C is so designed that one side opens or closes in relation to the base 30, with the other side as the center of rotation, by dint of the resilience of the coil spring 34 interposed between the protection cover 31 and the base 30, the protection cover 31 can be more precisely positioned, compared to a structure wherein the protection cover 31 is moved up and down to slide into the base 30, maintaining a parallel relationship to each other, consequently preventing the crooked part $33P_{1BX}$~$33P_{7BX}$ of the electrode terminals $33P_1$~$33P_7$ from distorting by touching the rims of the corresponding electrode projection slits $31H_1$ to $31H_7$, a malfunction possibly caused by the protection cover 31 being mispositioned against the base 30.

Furthermore, power supplying and grounding are allotted respectively to the electrode terminals $33P_1$ and $33P_7$ located at the far ends of a plurality of the electrode terminals $33P_1$ and $33P_7$. The crooked part $33P_{1BX}$ and $33P_{7BX}$ of the electrode terminals $33P_1$ and $33P_7$ is designed to come higher than that of the rest of other electrode terminals $33P_2$~$33P_6$ so as to prevent misoperations, possibly caused by a happening of the electrode terminals $33P_2$~$33P_6$, connected to other signal lines, becoming electrically conductive.

With the pet robot 10 being configured as described heretofore, the electrode terminals $33P_1$~$33P_7$ of the first half of connector 12C placed on the station 12 come out only when the pet robot 11 is connected to the station 12, thereby preventing the electrode terminals $33P_1$~$33P_7$ from getting dirty or broken and protecting the user from getting electrically shocks or injuries by touching the electrode terminals $33P_1$~$33P_7$, thus embodying the pet robot system 10 with significantly enhanced reliability and safety.

(5) Other Modes of Carrying Out the Present Invention

One mode of embodiment of this invention has been so far described, referring to the robot 10 configured as shown in FIG. 1. However, the present invention is not limited to this embodiment, but can be applied to a wide variety of other robots in different configurations. Also, a connecting device embodying the present invention has been described, referring to the configuration of the connector 18, comprising a connector half unit 12C having the electrode terminals $33P_1$~$33P_7$ and another connector half unit 13C having the electrode terminals $41P_1$~$41P_7$ corresponding to the electrode terminals $33P_1$~$33P_7$. However, the present invention is not limited to this embodiment, but can be applied to a wide variety of other connecting means.

Also, in the above mode of embodiment, the first connector half unit 12C has been described, referring to the case wherein the protection cover (cover) 31 is placed on it. This cover has the electrode projection slits $31H_1$~$31H_7$ corresponding to the electrode terminals $33P_1$~$33P_7$ usually covered and sticking out of said slits $31H_1$~$31H_7$ only when the second connector half unit 13C is pushed against the first connector 12C. However, the present invention is not limited to this embodiment, but can be applied to a variety of other covers in different configurations so long as the electrode terminals $33P_1$~$33P_7$ are covered up when the first and second connector half units 12C and 13C are not in contact with each other.

Also, this mode of embodiment is described referring to the case wherein the first connector half unit 12C has the guide pins 32A and 32B, corresponding to which the reference holes 40HA and 40HB for positioning are provided on the second connector half unit 13C. However, the present invention is not limited to this embodiment, but can be applied to a variety of other guide pins and reference holes in different configurations so long as positioning is regulated in connecting both the connectors 12C and 13C.

Also, in the this mode of carrying out the present invention, as to the first connector half unit 12C, of a plurality of the terminals $33P_1$~$33P_7$ the two terminals $33P_1$ and $33P_7$ located at the far ends are allotted for power supplying and grounding, of which crooked part $33P_{1BX}$ and $33P_{7BX}$ is so designed as to come higher than that of the rest of other electrode terminals $33P_2$~$33P_6$. However, the present invention is not limited to this mode, and any two terminals in the middle may be allotted for power supplying and grounding. Moreover, they may be used as terminals for a variety of other signals than power supplying and grounding if necessary.

INDUSTRIAL APPLICABILITY

This invention can be applied to connecting means requiring electrical linkage in connecting devices and robots.

What is claimed is:

1. A connecting device comprising:

a first connector half unit having first electrodes and a second connector half unit having second electrodes;

said first connector half unit comprising an insulated cover pivotally connected to a base at one end thereof and spring-biased in relation thereto, said insulated cover having electrode projection holes corresponding to said first electrodes, and which is pivotable between a first position, wherein said first electrodes are covered by said cover, and a second position, wherein said first electrodes extend from said electrode projection holes without the cover contacting the first electrodes when the second connector half unit is pushed against the first connector half unit;

guide pins placed on the first connector half unit; and positioning reference holes placed on the second connector half unit corresponding to said guide pins.

2. A connecting device as defined in claim 1 wherein:

said first connector half unit has a plurality of said first electrodes, some of which project higher than the rest of the other of the first electrodes in the direction of the connecting point to the second connector half unit.

3. A robot comprising charging means comprising:

a first connector half unit with first electrodes and a second connector half unit with second electrodes corresponding to said first electrodes;

said first connector half unit comprising an insulated cover pivotally connected to a base at one end thereof and spring-biased in relation thereto, said insulated cover having electrode projection holes corresponding to said first electrodes, and which is pivotable between a first position, wherein said first electrodes are covered by said cover, and a second position, wherein said first electrodes extend from said electrode projection holes without the cover contacting the first electrodes when the second connector half unit is pushed against the first connector half unit;

guide pins placed on said first connector half unit; and positioning reference holes placed on said connector half unit corresponding to said guide pins.

4. A robot as defined in claim 3 wherein:

said first connector half unit has a plurality of the first electrodes, some of which project higher than the rest of the other of the first electrodes in the direction of the connecting point to the second connector half unit.

* * * * *